United States Patent [19]

Novotny et al.

[11] 4,398,780

[45] Aug. 16, 1983

[54] SHIELDED ELECTRICAL CONNECTOR

[75] Inventors: Lawrence G. Novotny, Clemmons; Elvert S. Watts, Walkertown, both of N.C.

[73] Assignee: AMP Incorporated, Harrisburg, Pa.

[21] Appl. No.: 418,367

[22] Filed: Sep. 15, 1982

Related U.S. Application Data

[63] Continuation of Ser. No. 181,014, Aug. 25, 1980, abandoned, which is a continuation-in-part of Ser. No. 54,759, Jul. 3, 1979, abandoned.

[51] Int. Cl.[3] ..... H01R 13/658

[52] U.S. Cl. ..... 339/49 R; 339/92 M; 339/138; 339/143 R

[58] Field of Search ..... 339/92, 136, 137, 138, 339/47, 48, 49, 143 R, 141

[56] References Cited

U.S. PATENT DOCUMENTS

| | | | |
|---|---|---|---|
| D. 229,314 | 11/1973 | Averitt | D26/1 A |
| 2,790,153 | 4/1957 | Arson | 339/136 M |
| 3,056,942 | 10/1962 | Carbaugh | 339/92 M |
| 3,178,669 | 4/1965 | Roberts | 339/49 R |
| 3,219,963 | 11/1965 | O'Keefe | 339/92 M |
| 3,662,321 | 5/1972 | Bury | 339/92 M |
| 3,692,966 | 9/1972 | Lancaster | 339/17 LM |
| 3,758,935 | 9/1973 | Long et al. | 29/203 MW |
| 3,760,335 | 9/1973 | Roberts | 339/99 R |
| 3,764,957 | 10/1973 | Iversen | 339/92 M |
| 3,781,766 | 12/1973 | Teagno et al. | 339/107 |
| 3,824,552 | 7/1974 | Kirby | 339/128 |
| 3,876,276 | 4/1975 | Ayer | 339/107 |
| 3,904,265 | 9/1975 | Hollyday et al. | 339/103 M |
| 3,920,306 | 11/1975 | Barnett, Jr. et al. | 339/103 M |
| 4,032,211 | 6/1977 | Tucci | 339/99 R |

FOREIGN PATENT DOCUMENTS 2020494 11/1979 United Kingdom .

*Primary Examiner*—John McQuade

*Attorney, Agent, or Firm*—Gerald K. Kita; Robert W. J. Usher

[57] ABSTRACT

A shielded connector for shielded cable provides a plug and receptacle coupled to multiple wires of the cable, together with metal shells with facility for stacking and interlocking multiple shielded connectors.

3 Claims, 5 Drawing Figures

52
54
1
58
22
56
12B
12A
12
18
12C
16
18
10A
10
21
23
18
4A
10C
4
7
18
19
16
2
4B
10B
25
40
6
38
8
32
40
24
20
26
28
40
44
36
46
42
40
34
30

SHIELDED ELECTRICAL CONNECTOR

CROSS-REFERENCE TO RELATED APPLICATION

This is a continuation, of application Ser. No. 181,014, filed Aug. 25, 1980, now abandoned which is a continuation-in-part of application Ser. No. 054,759 filed July 3, 1979 now abandoned.

FIELD OF THE INVENTION

The invention pertains to an electrical connection for the multiple wires of electrical cables, and more particularly, to a shielded connector having a plastic plug connector half and/or a plastic receptacle half enclosed in a metal shell which provides electrical shielding. In one version both a plug and receptacle are enclosed in a two piece metal shell capable of stacking and interlocking multiple connectors, on the side of either the plug or the receptacle.

BACKGROUND OF THE INVENTION

Communications cable having multiple wires sometimes includes a metal sheath, of foil or braided metal, to shield the wires from electromagnetic interference. The wires are exposed outwardly from an end of the cable for connection to the terminals of the electrical connector. The wire connections, as well as the connector terminals, must also be shielded. Usually this can be accomplished by providing a metal shell enclosing the connector and the wire connections. The shell must be commoned electrically to the cable sheath to assure unbroken, continuous shielding. In a version of the present invention, a metal shell encloses a pair of connectors comprising a plug and receptacle which are jumper interconnected by the multiple wires of a shielded electrical cable. The plug and receptacle have their mating sides facing in opposite directions. The shell envelopes the connectors with the mating sides being accessible through the shell to provide plug and receptacle interfaces. The shell provides an overhanging flange encircling each of the interfaces. The shell grips the cable sheath to provide a strain relief and a commoned electrical connection of the shell and the cable shielding.

An object of the present invention is to provide a connector for multiple wire pairs of a shielded electrical cable having composite plug and receptacle connectors interconnected by jumper wires of the cable and providing plug and receptacle interfaces accessible through a metal shell which is commoned to the shielding of the cable.

Another object is to provide back to back electrical connectors that are jumper interconnected by multiple wires of a shielded cable and contained within a shell for shielding the connectors and the wire connections thereof, so that plural shells and their corresponding connectors may be stacked and intermated to connect together plural shielded cables.

DRAWINGS

FIG. 3 is an enlarged section view, taken along line 3—3 of FIG. 2, of a pair of connectors of the type shown in FIG. 2 coupled together and interconnecting their corresponding cables.

DETAILED DESCRIPTION

Figure 1:
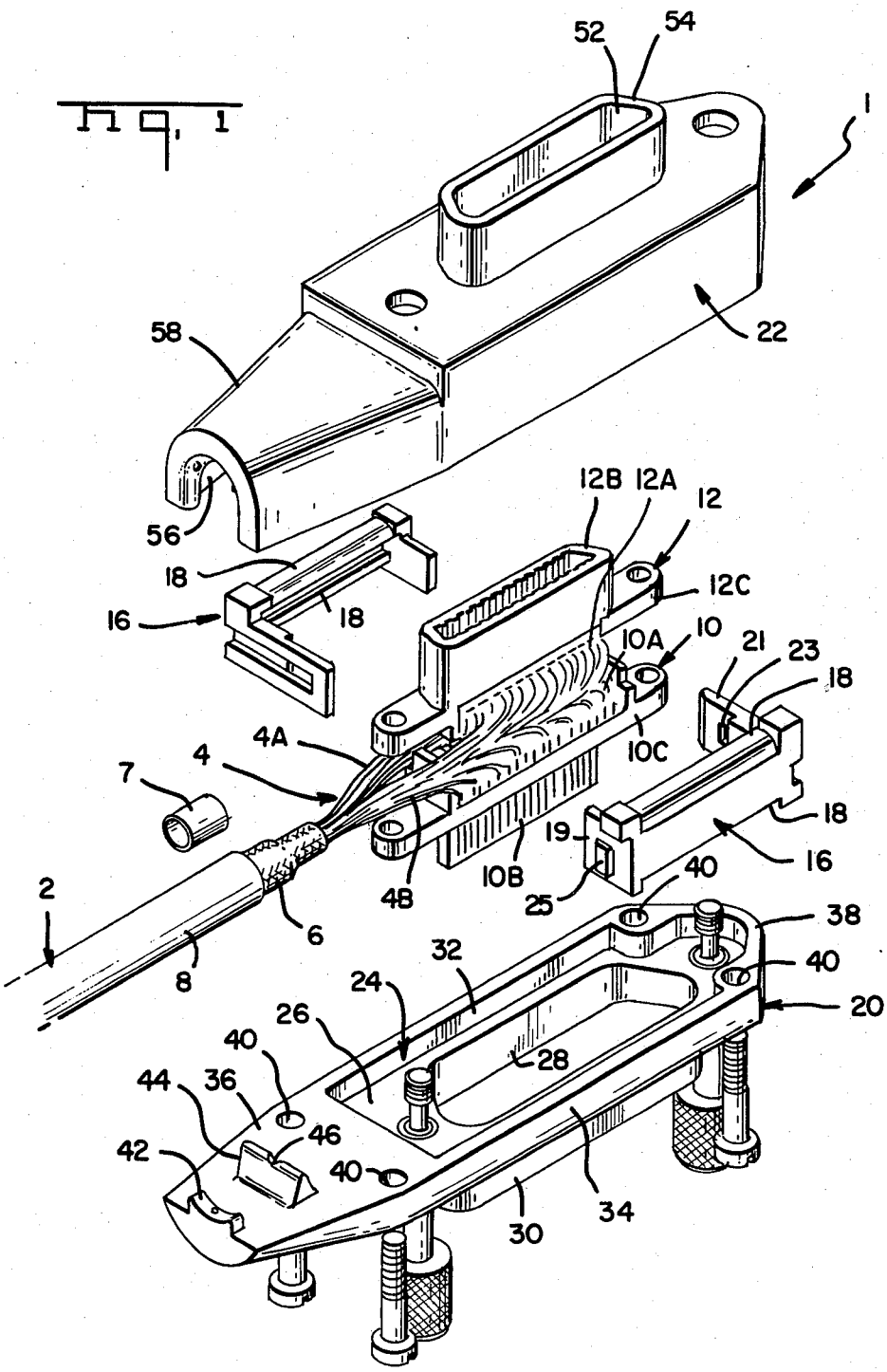
FIG. 1 is an enlarged perspective with parts exploded and illustrating the details of a preferred embodiment of a shielded connector terminated to multiple wire pairs of a shielded electrical cable.
Figure 2:
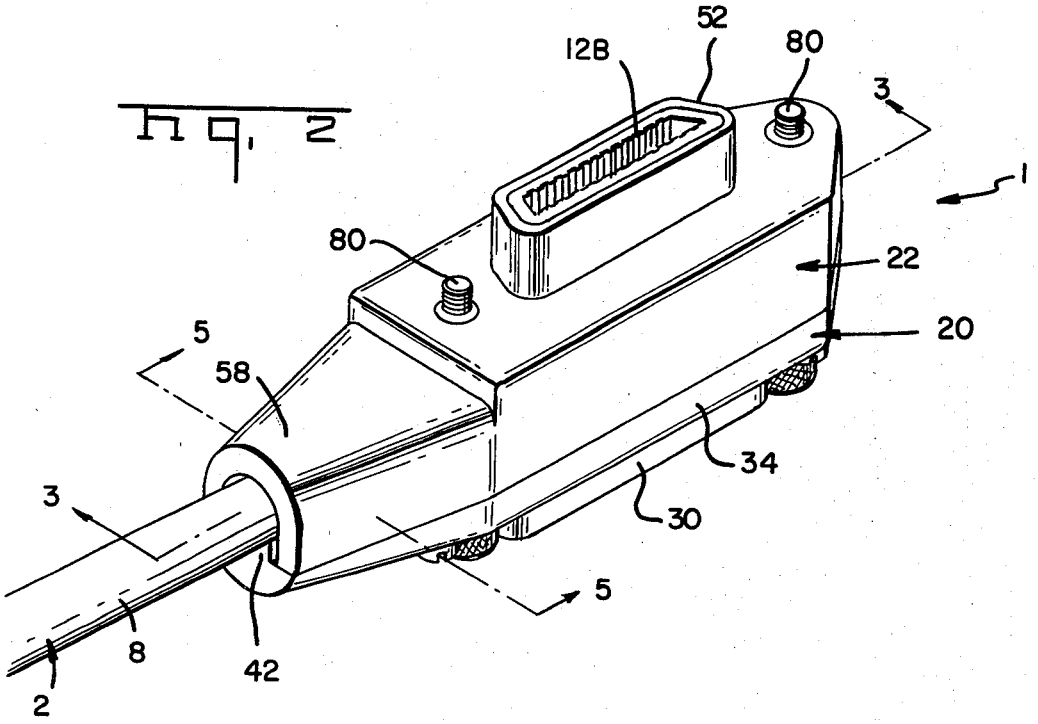
FIG. 2 is an enlarged perspective of the embodiment shown in FIG. 1, with parts assembled.

With more particular reference to the drawings, there is illustrated in FIGS. 1 and 2 an electrical connector 1 for shielded cable 2 of the type having multiple pairs of insulated wires 4 enclosed within a conductive sheath 6 of metal braid which surrounds an insert in the form of a sleeve of soft, resilient dielectric 7. The sheath 6 is contained within an outer jacket 8 of plastic material. The wires 4 are connected to corresponding electrical terminals in each of two connectors. As shown in FIG. 3 one of the connectors is a plug 10, and the other is a receptacle 12, in back to back relationship. Connection of the wires 4 to the terminals of the plug 10 and also of the receptacle 12 is accomplished in accordance with the disclosure of U.S. Pat. No. 4,032,211. Briefly, in summary of the patent disclosure and of FIG. 1 and FIG. 3, the plug has a wire receiving side 10A facing toward a wire receiving side 12A of the receptacle 12. Sides 10A and 12A are provided with two rows of wire receiving channels 14. The channels of side 10A are aligned with corresponding channels in the side 12A. Suitable apparatus is used to trim and insert corresponding wires 4 along the aligned channels 14, thereby providing jumper interconnections, bridged between the plug and receptacle. Electrical terminals of the type disclosed in U.S. Pat. No. 3,760,335 have their adjacent respective mating sides 10B and 12B respectively in the connectors 10 and 12, and the terminals have wire connecting portions located in the channels 14 of each connector 10 and 12. The wire receiving portion of each terminal will penetrate the insulation of a wire when the same is inserted along a corresponding channel, and establish electrical contact with the conductor portion of the wire. The wires 4 are divided into two groups, 4A and 4B as shown in FIG. 1. One group of wires 4A is shown in FIG. 1 and FIG. 3 distributed along the row of the channels 14 and making electrical connections to the wire connection portions of corresponding electrical terminals in the channels 14. Another group of wires 4B is distributed along and connected to the wire connecting portions of electrical terminals located in the rows of channels 14 along the back sides of the respective connector sides 10A and 12A and parallel to the channels to which the wires of group 4A are connected. The connected wires 4A and 4B are then covered by a pair of strain relief clasps 16, each molded of one piece from a plastic material. Each clasp 16 is of a length and width to cover a respective pair of opposed sides 10A and 12A. The longitudinal surfaces of each channel are rounded to define undercut channels 18 along the lengths of each clasp to provide a clearance for corresponding wires 4A or 4B. The rounded surfaces prevent pinching damage to any of the wires. One end of each clasp 16 is provided with an integral projecting latching finger 19. The other end is molded with an integral projecting clasp 12 of a length to cover the ends of the mating sides 10A or 12A. The clasp 21 has a central opening 23 into which an integral projection 25 on a latching finger 19 of the other clasp 16 is frictionally fit to couple the clasps 16 together. The clasps cover the channels 14 and thereby the wires 4A and 4B contained in the channels to prevent accidental disconnect of the wires from the electrical terminals.

The connectors 10 and 12 are arranged with a receptacle mating side 12B and a plug mating side 10B projecting in opposite directions. A flange 12C on the receptacle 12 separates the mating side 12B from the wire receiving side 12A. Similarly, a flange 10C separates the plug mating side 10B from the wire receiving side 10A. Metal shells 20 and 22 are provided to enclose the connectors 10 and 12. The peripheries of the flanges 12C and 10C may be trimmed or otherwise reduced to fit within the confines of the corresponding shells 20 and 22.

The shell 20 is fabricated of cast aluminum and coated with a chromate conversion coating according to the publicly available military specification; MIL-C-5541. The coating provides improved electrical conduction of the surface of the aluminum. The shell includes an interior cavity 24, receiving the connector 10 therein. A bottom wall 26 of the cavity 24 is provided with an elongated opening 28 encircled by an overhanging flange 30 projecting from the exterior of the bottom wall 26. The cavity 24 is surrounded by side walls 32 and 34 merging with end walls 36 and 38, each of which are provided with bores 40. The end 36 is cast with a projecting arcuate strain relief cradle 42, and a projecting crimping pedestal 44, the ridge of which is provided with an arcuate depression or recess 446.

Figure 4:
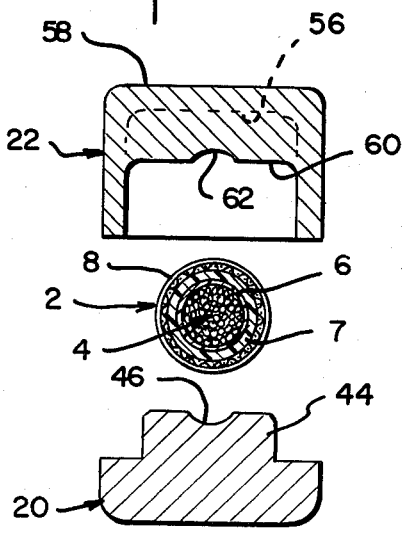
FIGS. 4 and 5 are enlarged sections taken along the line 5—5 of FIG. 2, with FIG. 4 illustrating an exploded configuration of the component parts illustrated in FIG. 5.
Figure 5:
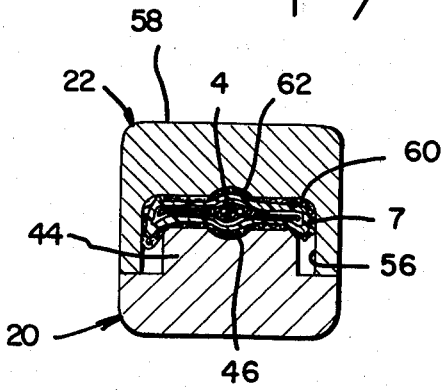
Figure 7:
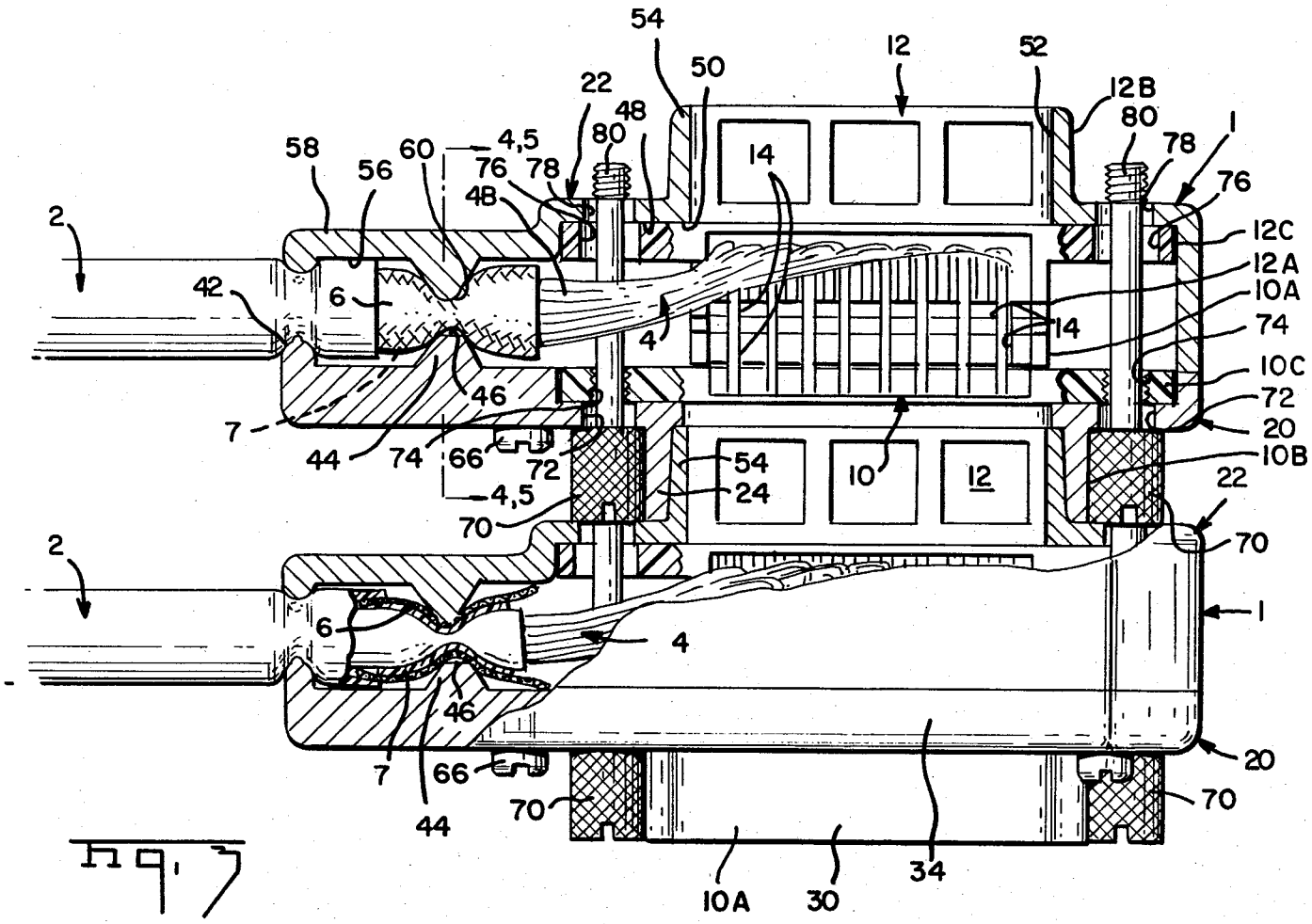

The other shell 22 is a similar fabrication, and is provided with a cavity 48 receiving the connector 12 therein. A bottom wall 50 of the cavity 48 includes an opening 52 therethrough which is encircled by a projecting overhanging flange 54. A cable receiving opening 56, open along its side, extends along one end 58 of the shell 22. The end 58 is provided with an integral projecting strain relief pedestal 60 similar to the pedestal 44 of the shell 20. The ridge of the pedestal 60 includes an arcuate recess 62. FIGS. 4 and 5 illustrate the shells 20 and 22 mated together, with the pedestal 44 in alignment with the pedestal 60 and on opposite sides of the cable 2. FIG. 5 illustrates the shells 20 and 22 mated together with the pedestals 44 and 62 compressing against the exposed portion of the conductive sheath 6. The cable 2 is substantially flattened and distributed along the clearance defined by the recess 56 and the pedestal 60 and the periphery of the pedestal 46. The sleeve 7 is flattened and also substantially indented and compressed to distribute the forces of compression, to take up variations in the clearance due to tolerance and temperature variations and to cushion wires 4. The size of the clearance, and thereby the compression on the cable 2, is limited by abutting the shells 20 and 22 against each other. The shells 20 and 22 thereby establish good electrical and mechanical connection of the pedestals 42 and 60 with the conductive sheath 6.

FIG. 3 illustrates two connectors 1 coupled together. Each comprises an intermediate pair of shells 20 and 22 enclosing a pair of back to back connectors 10 and 12. The clasps 19 which cover the channels 14 are eliminated for the purposes of illustrating other features of the connector. In each connector, the flange 10C of the connector 10 will seat against the bottom wall 26 with the plug mating side 10B projecting into the opening 28 to be encircled by the flange 30. Similarly, the connector flange 12C will seat against the bottom wall 50 with the receptacle mating side 12A being received by the opening 52 and being encircled by the flange 54. Pan head screws 66 freely pass through bores 40 and threadably connect in tapped bores (not shown) of the shell 22. Elongated jack screws 70 pass through openings 72 in the shell 20, openings 74 in the flange 10C, openings 76 in the flange 12C and openings 78 in the shell 22. Each jack screw 70 includes an enlarged threaded end 80 which projects outwardly from the shell 22. The end 80 of each jack screw is threadably advanced into corresponding heads of another set of jack screws 70 which are assembled to the other connector 1. When the connectors 1 are coupled together, the receptacle mating side 12B of a first connector will intermate with a plug mating face 10B of the other connector. The shell flange 54 will interfit frictionally within the shell flange 30 to assure electrical continuity between the connectors 1 and the conductive sheaths of the respective cables to which the connectors are assembled. Although one or more preferred embodiments of the present invention are disclosed in detail, other embodiments and modifications thereof which would be apparent to one having ordinary skill of the art are intended to be covered by the spirit and scope of the appended claims.

What is claimed is:

1. A shielded connector for multiple conductor cable having a male and female connector pair with terminals thereof having aligned wire connecting portions and oppositely projecting mating portions adjacent mating sides of said connector pair, the improvement comprising:

first and second metal intermated shells enclosing said connector pair and having a first opening encircled by a first flange exposing a first mating side of one of said pair of connectors, and second opening encircled by a second flange exposing a mating side of the other of said connectors, said shells enclosing a cable entrance for wires connected to said pair of connectors, and fastener means extending through said intermated shells to connect together, plural, stacked pairs of intermated shells, and wherein a plug mating side of said pair of connectors will interfit with a receptacle mating side of another of said pair of connectors so that a pair of multiple conductor cables are electrically coupled together.

2. The structure as recited in claim 1, wherein, said fastener means include cap screws with enlarged threaded shank portions constructed for threadable connection to head portions of additional cap screws of another intermated pair of said shells.

3. The structure as recited in claim 1, wherein each said flange of said shells includes an overhang encircling a mating side of a respective said connector.

* * * * *